US011279986B2

(12) United States Patent
Zhou et al.

(10) Patent No.: US 11,279,986 B2
(45) Date of Patent: Mar. 22, 2022

(54) COLD-ROLLED HIGH-STRENGTH STEEL HAVING TENSILE STRENGTH OF NOT LESS THAN 1500 MPA AND EXCELLENT FORMABILITY, AND MANUFACTURING METHOD THEREFOR

(71) Applicant: BAOSHAN IRON & STEEL CO., LTD., Shanghai (CN)

(72) Inventors: Shu Zhou, Shanghai (CN); Yong Zhong, Shanghai (CN); Li Wang, Shanghai (CN)

(73) Assignee: BAOSHAN IRON & STEEL CO., LTD., Shanghai (CH)

( * ) Notice: Subject to any disclaimer, the term of this patent is extended or adjusted under 35 U.S.C. 154(b) by 152 days.

(21) Appl. No.: 16/342,842

(22) PCT Filed: Sep. 20, 2017

(86) PCT No.: PCT/CN2017/102384

§ 371 (c)(1),
(2) Date: Apr. 17, 2019

(87) PCT Pub. No.: WO2018/076965

PCT Pub. Date: May 3, 2018

(65) Prior Publication Data

US 2019/0256945 A1 Aug. 22, 2019

(30) Foreign Application Priority Data

Oct. 31, 2016 (CN) ..... 201610928382.3

(51) Int. Cl.

| | |
|---|---|
| ***C22C 38/38*** | (2006.01) |
| ***C21D 9/52*** | (2006.01) |
| ***C21D 1/26*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |

(Continued)

(52) U.S. Cl.

CPC ..... *C21D 9/52* (2013.01); *C21D 1/26* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0273* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/24* (2013.01); *C22C 38/26* (2013.01); *C22C 38/28* (2013.01); *C22C 38/38* (2013.01); *C21D 2211/001* (2013.01); *C21D 2211/002* (2013.01); *C21D 2211/005* (2013.01); *C21D 2211/008* (2013.01)

(58) Field of Classification Search

CPC . C21D 9/52; C21D 1/26; C21D 6/002; C21D 6/005; C21D 6/008; C21D 8/0205; C21D 8/0226; C21D 8/0236; C21D 8/0263; C21D 8/0273; C21D 2211/001; C21D 2211/002; C21D 2211/005; C21D 2211/008; C22C 38/001; C22C 38/002; C22C 38/02; C22C 38/04; C22C 38/06; C22C 38/12; C22C 38/14; C22C 38/18; C22C 38/22; C22C 38/24; C22C 38/26; C22C 38/28; C22C 38/34; C22C 38/38

See application file for complete search history.

(56) References Cited

U.S. PATENT DOCUMENTS

| | | | | |
|---|---|---|---|---|
| 9,121,087 | B2 | 9/2015 | Matsuda et al. | |
| 2011/0146852 | A1* | 6/2011 | Matsuda ..... | C21D 6/00 148/533 |

(Continued)

FOREIGN PATENT DOCUMENTS

| | | | |
|---|---|---|---|
| CN | 100410409 | C * | 8/2008 |
| CN | 101624683 | | 1/2010 |

(Continued)

OTHER PUBLICATIONS

International Search Report & Written Opinion dated Nov. 24, 2017 for PCT Patent Application No. PCT/CN2017/102384.

(Continued)

*Primary Examiner* — Sally A Merkling
*Assistant Examiner* — Dean Mazzola
(74) *Attorney, Agent, or Firm* — Lei Fang; Smith Tempel Blaha LLC

(57) ABSTRACT

Provided is a cold-rolled high-strength steel having a tensile strength of not less than 1500 MPa and an excellent formability, the chemical elements thereof having the following mass percent ratios: 0.25%-0.40% of C, 1.50%-2.50% of Si, 2.0%-3.0% of Mn, 0.03%-0.06% of Al, P≤0.02%, S≤0.01%, N≤0.01% and at least one of 0.1%-1.0% of Cr and 0.1%-0.5% of Mo, with the balance being Fe and other unavoidable impurities. The microstructure of the cold-rolled high-strength steel has 5%-20% of residual austenite and 70%-90% of martensite, and the carbon concentration ratio of the residual austenite to the martensite is greater than 3.5 and less than 15. The cold-rolled high-strength steel sheet has a high strength and an excellent formability through a rational ingredient design and microstructure control.

8 Claims, No Drawings

(51) Int. Cl.

| | |
|---|---|
| ***C22C 38/24*** | (2006.01) |
| ***C22C 38/26*** | (2006.01) |
| ***C22C 38/28*** | (2006.01) |
| ***C22C 38/04*** | (2006.01) |
| ***C22C 38/14*** | (2006.01) |
| ***C22C 38/12*** | (2006.01) |
| ***C22C 38/18*** | (2006.01) |

(56) References Cited

U.S. PATENT DOCUMENTS

| | | | | |
|---|---|---|---|---|
| 2011/0198002 | A1* | 8/2011 | Nakagaito | C21D 6/008 148/533 |
| 2017/0137910 | A1* | 5/2017 | Girina | C21D 8/0247 |

FOREIGN PATENT DOCUMENTS

| | | | | |
|---|---|---|---|---|
| CN | 102227511 | A | | 10/2011 |
| CN | 103320700 | | | 9/2013 |
| CN | 103805838 | | | 5/2014 |
| CN | 103805840 | | | 5/2014 |
| CN | 104561793 | | | 4/2015 |
| JP | 2009209450 | A | | 9/2009 |
| JP | 2009287102 | A | * | 12/2009 |
| JP | 2015224359 | | | 12/2015 |
| KR | 20110039395 | A | | 4/2011 |
| WO | 2010029983 | A1 | | 3/2010 |
| WO | WO-2016001707 | A1 | * | 1/2016 C23C 2/28 |
| WO | 2016084847 | A1 | | 6/2016 |

OTHER PUBLICATIONS

1st Office Action dated Feb. 3, 2019 for Chinese Patent Application No. 201610928382.3.

1st Search Report dated Feb. 3, 2019 for Chinese Patent Application No. 201610928382.3.

Notice of Allowance dated Oct. 17, 2019 for Chinese Patent Application No. 201610928382.3.

European Search Report dated Feb. 13, 2020 for European Patent Application No. 17/863,565.

1st Office Action dated May 19, 2020 for Japanese Patent Application No. 2019517956.

Notice of Allowance dated Sep. 1, 2020 for Japanese Patent Application No. 2019517956.

Office Action dated Sep. 25, 2020 for Korean Patent Application No. 20197014024.

Office Action dated Feb. 8, 2021 for Korean Patent Application No. 20197014024.

Guo, Haoran, et al. "Structure-property relation in a quenched-partitioned low alloy steel involving bainite transformation." Materials Science and Engineering: A 667 (2016): 224-231.

de Diego-Calderón, I., et al. "Microstructural design in quenched and partitioned (Q&P) steels to improve their fracture properties." Materials Science and Engineering: A 657 (2016): 136-146.

* cited by examiner

COLD-ROLLED HIGH-STRENGTH STEEL HAVING TENSILE STRENGTH OF NOT LESS THAN 1500 MPA AND EXCELLENT FORMABILITY, AND MANUFACTURING METHOD THEREFOR

CROSS-REFERENCE TO RELATED APPLICATIONS

This application is a 371 U.S. National Phase of PCT International Application No. PCT/CN2017/102384 filed on Sep. 20, 2017, which claims benefit and priority to Chinese patent application no. 201610928382.3, filed on Oct. 31, 2016. Both of the above-referenced applications are incorporated by reference herein in their entireties.

TECHNICAL FIELD

The present invention relates to a steel material and a method for manufacturing the same, and more particularly to a cold-rolled steel material and a method for manufacturing the same.

BACKGROUND ART

In recent years, in order to reduce the weight of vehicles, save energy, improve collision safety and reduce manufacturing costs, more and more steel sheets with tensile strengths of 1000 MPa or more have been used in the design of complex body structures and safety components of vehicles. However, as the strength level of the steel sheet increases, the formability drops sharply, and the problem of press cracking stamping of parts becomes increasingly obvious. Therefore, it has become an important project to improve the formability of a high-strength steel sheet and to avoid cracking in stamping forming.

The Chinese patent document titled "high-strength cold-rolled steel sheet having excellent formability, high-strength galvanized steel sheet, and methods for manufacturing the same" with a publication number of CN102227511A and a publication date of Oct. 26, 2011 disclosed a high-strength cold-rolled steel sheet and high-strength galvanized steel sheet having a TS of 1180 MPa or more and excellent formability including stretch flangeability and bendability and also relates to methods for manufacturing the same. The patent provides a steel sheet having a martensite phase, a ferrite phase and a residual austenite phase by continuous annealing, wherein the martensite content is 30% or more, and the content ratio of martensite to ferrite is 0.45~1.5. However, the tensile strength of the steel sheet disclosed in the patent is 1180 MPa or more, and cannot satisfy the strength requirement of 1500 MPa or more.

The Chinese patent document titled "high-strength cold-rolled steel sheet and method for manufacturing the same" with a publication number of CN104160055A and a publication date of Nov. 19, 2014 disclosed a high-strength cold-rolled steel sheet. However, the steel sheet has a tensile strength of 1180 MPa or more and an elongation after fracture of 16% or more, which cannot meet the strength requirement of 1500 MPa or more.

In view of this, it is desired to obtain a cold-rolled high-strength steel sheet having both a very high strength of 1500 MPa or more and good formability. The steel sheet is therefore particularly suitable for the manufacture of complex body structural members and safety components, in line with the requirements of lightweight automobiles. At the same time, it is also desired to obtain a manufacturing method for the steel sheet, which has simple process and strong applicability, and can be used in most existing production lines.

SUMMARY OF THE INVENTION

One of the objects of the present invention is to provide a cold-rolled high-strength steel having a tensile strength of 1500 MPa or more and excellent formability. Through proper design of components and the control of microstructure, the cold-rolled high-strength steel has excellent formability, high strength and an elongation after fracture of 12% or more.

Based on the above objects, the present invention provides a cold-rolled high-strength steel having a tensile strength of 1500 MPa or more and excellent formability, comprising the following chemical elements in mass percentage:

C: 0.25~0.40%, Si: 1.50~2.50%, Mn: 2.0~3.0%, Al: 0.03~0.06%, P≤0.02%, S≤0.01%, N≤0.01%, and at least one of 0.1%~1.0% of Cr and 0.1%~0.5% of Mo, with the balance being Fe and other unavoidable impurities;

the microstructure of the cold-rolled high-strength steel has 5~20% of residual austenite and 70~90% of martensite, and the carbon concentration ratio of the residual austenite to the martensite is more than 3.5 and less than 15.

The design principle of the chemical elements of the cold-rolled high-strength steel according to the present invention is as follows:

Carbon: C is a solid solution strengthening element necessary for ensuring the strength of steel, and is an austenite stabilizing element. When the mass percentage of C is less than 0.25%, the amount of residual austenite is insufficient, and the strength of steel is low; and when the mass percentage of C is more than 0.40%, the weldability of the steel is remarkably deteriorated. Therefore, the mass percentage of carbon in the cold-rolled high-strength steel of the present invention is controlled to 0.25~0.40%.

In some preferred embodiments, the mass percentage of carbon is controlled to 0.28~0.32%.

Silicon: in the technical solution of the present invention, Si promotes the enrichment of carbon in the austenite phase and inhibits the formation of carbides, thereby stabilizing the residual austenite phase. When the mass percentage of Si is less than 1.50%, the effect thereof is not obvious. However, when the mass percentage of Si added is more than 2.50%, the embrittlement of the steel sheet becomes serious, which in turn causes cracks at the edge of the steel sheet during cold rolling, thereby reducing production efficiency. Therefore, the mass percentage of silicon in the cold-rolled high-strength steel of the present invention is controlled to 1.5~2.5%.

In some preferred embodiments, the mass percentage of silicon is controlled to 1.6~2.0%.

Manganese: in the technical solution of the present invention, Mn increases the stability of austenite, and reduces the critical cooling temperature and the martensite transformation temperature Ms during steel quenching, thereby improving the hardenability of the steel sheet. Further, Mn is a solid solution strengthening element and is advantageous for increasing the strength of the steel sheet. When the mass percentage of manganese is more than 3.0%, cracks occur in steel slab, which affects the welding performance of the steel. Therefore, the mass percentage of Mn in the cold-rolled high-strength steel of the present invention is controlled to 2.0~3.0%.

In some preferred embodiments, the mass percentage of manganese is controlled to 2.6~2.9%.

Aluminum: in the technical solution of the present invention, Al is added for deoxidation of steel. When the mass percentage of Al is less than 0.03%, deoxidation cannot be achieved; and when the mass percentage of Al is more than 0.06%, the deoxidation effect is saturated. Therefore, the mass percentage of aluminum in the cold-rolled high-strength steel of the present invention is controlled to 0.03~0.06%.

Chromium and molybdenum: Cr and Mo increase the hardenability and thus the strength of steel. To ensure the hardenability of the steel, the present invention controls the mass percentage of Cr and Mo to at least one of 0.1%~1.0% of Cr and 0.1%~0.5% of Mo.

Phosphorus: in the technical solution of the present invention, P deteriorates the weldability, increases the cold brittleness of the steel, and reduces the plasticity of the steel. Therefore, the mass percentage of P is controlled to 0.02% or less.

Sulfur: in the technical solution of the present invention, S is a harmful element, which deteriorates the weldability and reduces the plasticity of the steel. Therefore, the mass percentage of S is controlled to 0.01% or less.

Nitrogen: in the technical solution of the present invention, N combines with Al to form AlN particles, which affects the ductility and thermoplasticity of the steel sheet. Therefore, the mass percentage of N is controlled to 0.01% or less.

Further, in the cold-rolled high-strength steel of the present invention, the microstructure of the cold-rolled high-strength steel has 5~20% of residual austenite and 70~90% of martensite for the following reasons. During the deformation process of cold-rolled high-strength steel, a certain amount of residual austenite transforms into martensite, which produces a phase transformation induced plasticity effect (that is, the TRIP effect), thereby ensuring that the cold-rolled high-strength steel of the present invention has good formability while having a tensile strength of 1500 MPa or more. When the amount of the residual austenite is less than 5%, the TRIP effect is not obvious, and the high formability of the steel sheet cannot be guaranteed. When the amount of residual austenite is more than 20%, the amount of martensite in the steel sheet is correspondingly small, and the high strength of the steel sheet cannot be achieved. As the hard phase of the steel sheet, martensite provides high strength to the steel sheet. In order to achieve a high strength of 1500 MPa or more, the cold-rolled high-strength steel of the present invention controls the content of martensite to 70%~90%. Further, in the cold-rolled high-strength steel of the present invention, the carbon concentration ratio of the residual austenite to the martensite is more than 3.5 and less than 15 for the following reasons. The carbon concentration in the residual austenite represents the stability of the residual austenite. When the carbon concentration ratio of the residual austenite to the martensite is less than 3.5, the stability of residual austenite is insufficient, so that the residual austenite tends to undergo martensite transformation at the beginning of the deformation process, resulting in insufficient TRIP effect and failure to significantly improve the formability of the steel sheet. When the carbon concentration ratio of the residual austenite to the martensite is more than 15, the residual austenite is too stable to undergo martensite transformation during deformation, resulting in insufficient TRIP effect and failure to improve the formability of the steel sheet. Thus, in the technical solutions of the present invention, the carbon concentration ratio of the residual austenite to the martensite is more than 3.5 and less than 15.

Further, in the cold-rolled high-strength steel of the present invention, the microstructure of the cold-rolled high-strength steel is residual austenite+martensite+ferrite or residual austenite+martensite+bainite.

Further, in the cold-rolled high-strength steel of the present invention, the mass percentages of chemical elements further satisfy: Mn+Cr+Mo≤3.8%. This is because when the sum of the mass percentages of Cr, Mn, and Mo is higher than 3.8%, the steel sheet tends to have an obvious banded structure and large cold rolling resistance.

Further, in the cold-rolled high-strength steel of the present invention, the mass percentages of chemical elements further satisfy: C+Si/30+Mn/20+2P+4S≤0.56%. The inventor of the present invention found through a large number of experiments that when the mass percentages of C, Si, Mn, P and S satisfy the formula of C+Si/30+Mn/20+2P+4S≤0.56%, the obtained cold-rolled high-strength steel has high strength and good welding performance. This is because when the mass ratio of the chemical elements satisfies the formula, the effects of structure strengthening and solid solution strengthening in the steel are better.

Further, the cold-rolled high-strength steel of the present invention has an elongation after fracture of 12% or more.

Further, the cold-rolled high-strength steel of the present invention further comprises at least one of 0.01-0.1% of Nb, 0.01-0.2% of V and 0.01-0.05% of Ti.

Wherein, Nb is added for the following reasons: Nb element can strengthen steel by precipitation strengthening, and can refine grains by inhibiting the overgrowth of austenite grains, thereby increasing the strength and the elongation after fracture of steel. The mass percentage of Nb is controlled to 0.01~0.10% for the following reasons: when the mass percentage of Nb is less than 0.01%, there is no effect; when the mass percentage of Nb is more than 0.10%, the precipitation strengthening is excessive, resulting in a decrease in formability of cold-rolled high-strength steel and an increase in manufacturing cost.

V is added because it forms carbides, which increases the strength of the steel. The mass percentage of V is controlled to 0.01~0.20% for the following reasons: when the mass percentage of V is less than 0.01%, the precipitation strengthening effect is not obvious; when the mass percentage of V is more than 0.2%, the precipitation strengthening is excessive, resulting in a decrease in formability of the steel sheet.

Ti is added because it forms precipitates with C, S and N, which effectively increase the strength and toughness of the steel sheet. The mass percentage of Ti is controlled to 0.01~0.05% for the following reasons: when the mass percentage of Ti is less than 0.01%, the effect thereof is not obvious; when the mass percentage of Ti is more than 0.05%, the improvement effect of further increasing the content thereof on steel is not obvious.

Further, another object of the present invention is to provide a manufacturing method for the above-described cold-rolled high-strength steel, comprising the steps of:

(1) smelting and casting;

(2) hot rolling;

(3) pickling;

(4) cold rolling;

(5) continuous annealing: heating a steel strip to a soaking temperature of 800~900° C. and holding for 60 s or more, then cooling the steel strip to 150~300° C. at a rate of 30~80° C./s, then reheating the steel strip to 350~440° C. and holding for 30~300 s, and finally cooling to room temperature.

In the manufacturing method of the present invention, the key point is the selection of parameters in the continuous annealing process in step (5). This is because the continuous annealing process diffuses the supersaturated carbon in the martensite into the residual austenite, causing the austenite to be carbon-rich and stably retained at room temperature, and the residual austenite undergoes a martensitic transformation during deformation to produce a TRIP effect, thereby ensuring high formability of the cold-rolled high-strength steel of the present invention. Meanwhile, the large amount of martensite in the microstructure ensures the high strength of the cold-rolled high-strength steel of the present invention.

Therefore, the present invention selects the parameters of the annealing process in order to ensure sufficient residual austenite and martensite in the structure. The design principles of the parameters are as follows:

The soaking temperature in continuous annealing is controlled to 800~900° C. and the holding time is 60 s or more for the following reasons: when the soaking temperature is lower than 800° C. or the holding time is less than 60 s, the austenite transformation of the cold-rolled high-strength steel is insufficient, resulting in austenite structure unevenness and high ferrite content, and in the subsequent process, a sufficient amount of residual austenite and martensite cannot be formed, thereby the steel has low strength and insufficient elongation after fracture; when the soaking temperature is higher than 900° C., the matrix structure of the steel sheet after soaking transforms to austenite completely, resulting in a decrease in the stability of austenite, then in the matrix of steel sheet after annealing, the content of residual austenite is reduced, the strength of the steel is higher and the elongation after fracture is insufficient.

In some preferred embodiments, the soaking temperature is controlled to 820~870° C. Cooling to 150~300° C. at a rate of 30~80° C./s is for the following reasons: in the technical solutions of the present invention, the martensite critical cooling rate is 30° C./s, therefore, in order to ensure that only martensite transformation occurs during the cooling process, the cooling rate should not be less than 30° C./s; when the cooling rate is more than 80° C./s, the cooling cost required in production increases significantly. In addition, when the cooling termination temperature is lower than 150° C. at this cooling rate, all austenite transforms to martensite, and when the steel is cooled at room temperature, there is no residual austenite formed in the obtained microstructure, resulting in insufficient elongation after fracture of the steel. When the cooling termination temperature is higher than 300° C. at this cooling rate, the phase transformation of martensite is insufficient, resulting in insufficient content and instability of residual austenite during the subsequent reheating, thereby affecting the strength and formability of the steel.

In some preferred embodiments, the cooling termination temperature is 180~270° C.

In the manufacturing method of the present invention, in step (5), the reheating temperature is 350-440° C. and the heating time is 30-300 s for the following reasons: when the reheating temperature is lower than 350° C. or the reheating time is less than 30 s, the stabilization of residual austenite in the cold-rolled high-strength steel is insufficient, and when the steel is cooled at room temperature, the content of residual austenite in the microstructure is insufficient. When the reheating temperature is higher than 440° C. or the reheating time is more than 300 s, the temper softening of the steel is remarkable, resulting in a significant decrease in the strength of the cold-rolled high-strength steel.

Further, in the manufacturing method of the present invention, in step (2), in heating stage, the slab is heated to 1200~1300° C. and held for 0.5~4 h; in rolling stage, the final rolling temperature is controlled to 850° C. or more and the coiling temperature is controlled to 400~600° C.

The reasons for the above settings are as follows: in the heating stage, when the heating temperature is higher than 1300° C., the slab is overburned and the grains in the slab become coarse, resulting in a decrease in hot workability, Also, ultra-high temperature causes severe decarburization on the slab surface; when the heating temperature is lower than 1200° C., after the slab is descaled by high pressure water and primarily rolled, the finishing rolling temperature is too low, which may result in an overlarge deformation resistance of the blank. In addition, the holding time in heating stage is controlled to 0.5~4 h. When the holding time is more than 4 h, the grains in the slab become coarse and the surface of the slab is seriously decarburized. When the holding time is less than 0.5 h, the internal temperature of the slab is not uniform.

In some preferred embodiments, the heating temperature in the heating stage is further preferably 1210~1270° C.

In addition, the finish rolling temperature and the coiling time are controlled for the following reasons: when the finish rolling temperature is too low, the deformation resistance of the slab is too high, so that it is difficult to produce a finished product with acceptable quality; when the coiling temperature is higher than 600° C., an thick iron oxide, which is difficult to pickle, is formed on the surface of the steel sheet; when the coiling temperature is lower than 400° C., the coiling strength is high, which makes cold rolling difficult and affects production efficiency.

In some preferred embodiments, the coiling temperature is further preferably 450~550° C. Further, in the manufacturing method of the present invention, the pickling speed in step (3) is controlled to 80~120 m/min for the following reasons: in the manufacturing method of the present invention, when the pickling speed is higher than 120 m/min, the iron oxide on steel sheet surface cannot be completely removed, thereby forming a surface defect on the steel sheet; when the pickling speed is lower than 80 m/min, the speed of the rolling mill is low, which in turn affects the control of the shape of the steel sheet and reduces production efficiency.

Further, in the manufacturing method of the present invention, the cold rolling reduction in step (4) is controlled to 40~60%. In the technical solutions of the present invention, the increase of the cold rolling reduction is beneficial to increase the formation rate of austenite in the subsequent continuous annealing process, and is also beneficial to the improvement of structural uniformity of the steel sheet, thereby improving the ductility of the steel sheet. However, when the cold rolling reduction is higher than 60%, the deformation resistance of the material due to work hardening is extremely high, resulting in poor deformation of the cold-rolled high-strength steel sheet.

The present invention provides a cold-rolled high-strength steel having a tensile strength of 1500 MPa or more and excellent formability. Through proper design of components and the control of microstructure, the cold-rolled high-strength steel is excellent in formability while having high strength and an elongation after fracture of 12% or more.

In addition to the above advantages, the manufacturing method of the present invention achieves a cold-rolled high-strength steel sheet having high strength and excellent formability by controlling process parameters, especially by selecting continuous annealing process parameters. The cold-rolled high-strength steel sheet of the invention has promising application prospects in automobile structural parts, and is particularly suitable for manufacturing automobile structural parts and safety components which require high formability and strength.

DETAILED DESCRIPTION

The cold-rolled high-strength steel having a tensile strength of 1500 MPa or more and excellent formability and the manufacturing method thereof according to the present invention will be further explained and illustrated below with reference to specific Examples. However, the explanations and illustrations do not unduly limit the technical solutions of the present invention.

Examples 1-8 and Comparative Examples 1-4

The cold-rolled high-strength steels of Examples 1-8 and the conventional steel sheets of Comparative Examples 1-4 were prepared by the following steps:

(1) smelting and casting slabs according to the mass ratio of chemical elements listed in Table 1;

(2) hot rolling: in the heating stage, the slab was heated to 1200~1300° C. and held for 0.5~4 h; in the rolling stage, the final rolling temperature was controlled to 850° C. or more and the coiling temperature was controlled to 400~600° C.;

(3) pickling: the pickling speed was controlled to 80~120 m/min;

(4) cold rolling: the cold rolling reduction was controlled to 40~60%;

(5) continuous annealing: the steel was heated to a soaking temperature of 800~900° C. and held for 60 s or more, then cooled to 150~300° C. at a rate of 30~80° C./s, then reheated to 350~440° C. and held for 30~300 s, and finally cooled to room temperature.

Table 1 lists the mass ratios of chemical elements in the cold-rolled high-strength steels of Examples and the conventional steel sheets of Comparative Examples.

TABLE 1

(wt %, the balance is Fe and other inevitable impurity elements other than S, P, N)

| Chemical component NO. | C | Si | Mn | Cr | Mo | P | S | Al | N | Ti | Nb | V | Mn + Cr + Mo | C + Si/30 + Mn/20 + 2 P + 4S |
|---|---|---|---|---|---|---|---|---|---|---|---|---|---|---|
| A | 0.28 | 1.8 | 2.7 | 0.5 | — | 0.015 | 0.002 | 0.037 | 0.0042 | — | — | 0.05 | 3.2 | 0.51 |
| B | 0.31 | 1.7 | 2.5 | — | 0.3 | 0.01 | 0.004 | 0.053 | 0.0035 | 0.03 | 0.03 | — | 2.8 | 0.53 |
| C | 0.33 | 2 | 2.1 | 0.2 | 0.15 | 0.009 | 0.005 | 0.04 | 0.0028 | — | 0.03 | — | 2.45 | 0.54 |
| D | 0.36 | 1.6 | 2.4 | 0.1 | — | 0.007 | 0.003 | 0.032 | 0.0043 | 0.02 | — | — | 2.5 | 0.56 |
| E | 0.23 | 1.8 | 2.5 | — | 0.25 | 0.009 | 0.01 | 0.046 | 0.0032 | — | 0.05 | — | 2.75 | 0.47 |
| F | 0.3 | 1.2 | 2.7 | — | — | 0.013 | 0.008 | 0.031 | 0.0029 | — | — | — | 2.7 | 0.53 |

Table 2 lists the specific process parameters of the manufacturing method of the Examples and Comparative Examples.

TABLE 2

| | step (1) | step (2) | | | | step (3) | step (4) | step (5) | | | | | |
|---|---|---|---|---|---|---|---|---|---|---|---|---|---|
| | Chemical component NO. | Heating temperature (° C.) | Holding time (h) | Finish rolling temperature (° C.) | Coiling temperature (° C.) | Pickling speed (m/min) | Cold rolling reduction (%) | Soaking temperature (° C.) | Soaking time (min) | Rapid cooling rate (° C./s) | Rapid cooling termination temperature (° C.) | Reheating temperature (° C.) | Reheating time (s) |
| Example 1 | A | 1212 | 1.3 | 851 | 547 | 81 | 50 | 835 | 2.8 | 45 | 227 | 411 | 235 |
| Example 2 | A | 1271 | 1.8 | 890 | 469 | 101 | 55 | 802 | 1.3 | 34 | 256 | 364 | 267 |
| Example 3 | B | 1257 | 2.0 | 901 | 424 | 117 | 52 | 871 | 1.6 | 33 | 192 | 363 | 47 |
| Example 4 | B | 1249 | 3.8 | 896 | 540 | 118 | 43 | 821 | 2.3 | 68 | 232 | 416 | 202 |
| Example 5 | C | 1264 | 0.9 | 861 | 440 | 99 | 49 | 892 | 1.7 | 62 | 259 | 390 | 31 |
| Example 6 | C | 1263 | 2.5 | 853 | 491 | 84 | 50 | 886 | 1.8 | 35 | 178 | 391 | 272 |
| Example 7 | D | 1277 | 2.3 | 864 | 549 | 90 | 60 | 853 | 3 | 54 | 262 | 357 | 113 |
| Example 8 | D | 1243 | 3.6 | 870 | 458 | 110 | 50 | 880 | 2.9 | 40 | 265 | 404 | 84 |
| Comparative Example 1 | B | 1223 | 2 | 861 | 511 | 100 | 50 | 930 | 1.8 | 45 | 195 | 373 | 265 |
| Comparative Example 2 | C | 1206 | 2 | 919 | 531 | 100 | 50 | 829 | 2 | 45 | 320 | 404 | 83 |
| Comparative Example 3 | E | 1212 | 2 | 857 | 407 | 100 | 50 | 808 | 1.4 | 45 | 174 | 389 | 44 |
| Comparative Example 4 | F | 1259 | 2 | 894 | 481 | 100 | 50 | 841 | 2.9 | 45 | 167 | 421 | 198 |

Note:

The rapid cooling rate in Table 2 refers to the cooling rate when the steel is cooled to 150-300° C. at a speed of 30-80° C./s as defined in the claims. The chemical component numbers in Table 2 have the mass ratios of chemical elements of the corresponding chemical component numbers listed in Table 1, for example, Example 1 uses the mass ratio of chemical component A in Table 1.

The cold-rolled high-strength steels of the Examples and the conventional steel sheets of the Comparative Examples were subjected to various performance tests, and the obtained results of the tests were listed in Table 3. The yield strength and tensile strength tests are routine ones, methods of other tests are as follows:

Tensile test method: JIS No. 5 tensile test specimen was used, the stretching direction was parallel to the rolling direction.

Test method for the ratio of residual austenite phase ($V_\gamma$): Samples having a size of 15×15 mm were cut out from the steel sheets, and ground and polished to perform XRD quantitative test.

Test method for the ratio of martensite phase ($V\alpha$): Samples having a size of 15×15 mm were cut out from the steel sheets, and ground and polished to perform EBSD quantitative analysis.

Test method for carbon concentration of residual austenite ($x_C^\gamma$): Assuming that the Mn and Al concentrations in each constituent phase in the steel sheet structure did not change, the lattice constant $a_\gamma$ was obtained from the diffraction peak data of the residual austenite in XRD, and the carbon concentration was calculated by using the following empirical formula: $\alpha_\gamma=0.3556+0.00453x_C^\gamma+0.000095x_{Mn}^\gamma+0.00056x_{Al}^\gamma$, wherein $x_C^\gamma$, $x_{Mn}^\gamma$ and $x_{Al}^\gamma$ represent carbon concentration, manganese concentration and aluminium concentration of the residual austenite, respectively.

Test method for carbon concentration of martensite ($x_C^\alpha$): the carbon concentration was calculated by the formula: $x_C^\alpha=(x_C-x_C^\gamma\times V_\gamma)/V_\alpha$, using the obtained $V_\gamma$, $V_\alpha$, $x_C^\gamma$ and the carbon concentration of the design composition ($x_C$).

Table 3 lists the test results of the cold-rolled high-strength steels of Examples and the conventional steel sheets of Comparative Examples.

TABLE 3

| | Yield strength Rp0.2 (MPa) | Tensile strength Rm (MPa) | Elongation after fracture EL (%) | Ratio of residual austenite phase (%) | Ratio of martensite phase (%) | Carbon concentration of residual austenite (%) | Carbon concentration of martensite (%) | Carbon concentration ratio of residual austenite to martensite (%/%) |
|---|---|---|---|---|---|---|---|---|
| Example 1 | 1190 | 1541 | 12.8 | 7 | 75 | 1.06 | 0.27 | 3.9 |
| Example 2 | 1045 | 1522 | 13.2 | 8 | 70 | 1.26 | 0.26 | 4.9 |
| Example 3 | 1145 | 1594 | 15.2 | 10 | 82 | 1.45 | 0.21 | 6.8 |
| Example 4 | 1089 | 1556 | 19.3 | 15 | 80 | 1.31 | 0.15 | 8.5 |
| Example 5 | 1212 | 1589 | 17.7 | 11 | 85 | 1.37 | 0.23 | 5.8 |
| Example 6 | 1299 | 1615 | 16.1 | 8 | 87 | 1.20 | 0.29 | 4.1 |
| Example 7 | 964 | 1529 | 15.1 | 11 | 74 | 1.35 | 0.34 | 4.0 |
| Example 8 | 866 | 1571 | 17.4 | 11 | 78 | 1.03 | 0.37 | 2.8 |
| Comparative Example 1 | 816 | 1675 | 10.5 | 4 | 90 | 1.01 | 0.31 | 3.3 |
| Comparative Example 2 | 892 | 1574 | 9.2 | 7 | 80 | 0.90 | 0.36 | 2.5 |
| Comparative Example 3 | 1025 | 1282 | 14.1 | 12 | 72 | 1.16 | 0.13 | 9.2 |
| Comparative Example 4 | 1132 | 1512 | 11.3 | 10 | 80 | 1.12 | 0.24 | 4.7 |

It can be seen from Table 3 that all Examples of the present application have a tensile strength of 1500 MPa or more and an elongation after fracture of 12% or more, indicating that the cold-rolled high-strength steel of Examples of the present application has high strength and good formability.

As can be seen from Table 1 and Table 3, Comparative Example 3 used the chemical elements ratio of E, wherein the mass percentage of carbon is less than 0.25%, resulting in a strength of Comparative Example 3 being less than 1500 MPa; and Comparative Example 4 used the chemical elements ratio of F, wherein the mass percentage of silicon is less than 1.5%, resulting in a lower elongation after fracture of Comparative Example 4.

As can be seen from Table 2 and Table 3, the soaking temperature of Comparative Example 1 is higher than 900° C., so that the steel sheet undergoes a complete austenite transformation after soaking, resulting in austenite content of less than 5%. Therefore, although Comparative Example 1 has a tensile strength of more than 1500 MPa, the elongation after fracture is insufficient and the formability is poor. The rapid cooling termination temperature of Comparative Example 2 is higher than 300° C., so that the phase transformation of martensite is insufficient, resulting in a low content of residual austenite during the subsequent reheating, which ultimately leads to insufficient elongation after fracture of Comparative Example 2.

It should be noted that the above are merely specific examples of the invention. It is obvious that the present invention is not limited to the above Examples, but has many similar variations. All modifications that can be directly derived or associated by those skilled in the art are intended to be within the scope of the present invention.

The invention claimed is:

1. A cold-rolled high-strength steel comprising the following chemical elements in mass percentage:

C: 0.25-0.40%, Si: 1.50-2.50%, Mn: 2.0-3.0%, Al: 0.03-0.06%, P≤0.02%, S≤0.01%, N≤0.01%, at least one of: 0.1-1.0% of Cr and 0.1-0.5% of Mo, and at least one of: 0.01-0.1% of Nb, 0.01-0.2% of V, and 0.01-0.05% of Ti, with the balance being Fe and other unavoidable impurities;

wherein, the microstructure of the cold-rolled high-strength steel has 5-20% of residual austenite, 70-90% of martensite, and a ratio of the carbon concentration of the residual austenite to that of the martensite is more than 3.5 and less than 15, wherein the microstructure of the cold-rolled high-strength steel further comprises ferrite, and wherein the cold-rolled high-strength steel has a tensile strength of 1500 MPa or more.

2. The cold-rolled high-strength steel according to claim 1, wherein mass percentages of the chemical elements satisfy: Mn+Cr+Mo≤3.8%.

3. The cold-rolled high-strength steel according to claim 1, wherein mass percentages of the chemical elements satisfy:

$$C+Si/30+Mn/20+2P+4S \leq 0.56\%.$$

4. The cold-rolled high-strength steel according to claim 1, wherein the steel has an elongation after fracture of 12% or more.

5. A manufacturing method for the cold-rolled high-strength steel according to claim 1, comprising the steps of:

(1) smelting and casting;

(2) hot rolling;

(3) pickling;

(4) cold rolling;

(5) continuous annealing: heating a steel strip to a soaking temperature of 800-900° C. and holding for 60 s or more, then cooling the steel strip to 150-300° C. at a rate of 30-80° C./s, then reheating the steel strip to 350-440° C. and holding for 30-300 s, and finally cooling the steel strip to room temperature.

6. The manufacturing method according to claim 5, wherein in step (2), in a heating stage, a slab is heated to 1200-1300° C. and held for 0.5-4 h; and in a rolling stage, a final rolling temperature is controlled to 850° C. or more and a coiling temperature is controlled to 400-600° C.

7. The manufacturing method according to claim 5, wherein the pickling in step (3) is controlled at a speed of 80-120 m/min.

8. The manufacturing method according to claim 5, wherein a cold rolling reduction in step (4) is controlled to 40-60%.

* * * * *